US008002274B2

(12) United States Patent
Saito et al.

(10) Patent No.: US 8,002,274 B2
(45) Date of Patent: Aug. 23, 2011

(54) SHEET STACKING DEVICE, DRIVE CONTROL METHOD, AND COMPUTER PROGRAM PRODUCT

(75) Inventors: Takashi Saito, Kanagawa (JP); Masahiro Tamura, Kanagawa (JP); Nobuyoshi Suzuki, Tokyo (JP); Shuuya Nagasako, Kanagawa (JP); Naohiro Kikkawa, Kanagawa (JP); Kazuhiro Kobayashi, Kanagawa (JP); Tomohiro Furuhashi, Kanagawa (JP); Hitoshi Hattori, Tokyo (JP); Junichi Tokita, Kanagawa (JP); Akira Kunieda, Tokyo (JP); Ichiro Ichihashi, Aichi (JP); Hiroshi Maeda, Gifu (JP); Atsushi Kuriyama, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 155 days.

(21) Appl. No.: 12/453,200

(22) Filed: May 1, 2009

(65) Prior Publication Data

US 2009/0283961 A1 Nov. 19, 2009

(30) Foreign Application Priority Data

May 19, 2008 (JP) ..... 2008-130822

(51) Int. Cl.
*B65H 31/10* (2006.01)

(52) U.S. Cl. ..... 271/217; 271/213; 271/214

(58) Field of Classification Search ..... 271/213, 271/214, 215, 217; 270/58.13, 58.28
See application file for complete search history.

(56) References Cited

U.S. PATENT DOCUMENTS

| | | | | |
|---|---|---|---|---|
| 5,123,637 | A * | 6/1992 | Musaka | 271/117 |
| 5,201,509 | A * | 4/1993 | Kirchhoff et al. | 271/157 |
| 5,284,089 | A * | 2/1994 | Buck et al. | 101/232 |
| 6,231,045 | B1 | 5/2001 | Yamada et al. | |
| 6,318,718 | B1 * | 11/2001 | Ogata et al. | 271/213 |
| 6,322,070 | B2 | 11/2001 | Yamada et al. | |
| 6,378,860 | B1 * | 4/2002 | Gutierrez et al. | 271/217 |
| 6,416,052 | B2 | 7/2002 | Yamada et al. | |
| 6,631,896 | B2 | 10/2003 | Yamada et al. | |
| 6,986,511 | B2 | 1/2006 | Yamada et al. | |

FOREIGN PATENT DOCUMENTS

| | | |
|---|---|---|
| JP | 2000-177911 | 6/2000 |
| JP | 3557120 | 5/2004 |
| JP | 2005-170578 | 6/2005 |

OTHER PUBLICATIONS

Abstract of JP 2000-272806 published Oct. 3, 2000.

* cited by examiner

*Primary Examiner* — Jeremy Severson
(74) *Attorney, Agent, or Firm* — Harness, Dickey & Pierce, P.L.C.

(57) ABSTRACT

A sheet stacking unit that stacks sheets thereon is movable up and down. A lifting unit moves the sheet stacking unit up and down. A driving unit drives the lifting unit. A control unit controls a driving speed of the driving unit. A position detecting unit detects a position of the sheet stacking unit in an up-and-down direction. The control unit controls the driving speed according to the position of the sheet stacking unit detected by the position detecting unit.

18 Claims, 8 Drawing Sheets

SHEET STACKING DEVICE, DRIVE CONTROL METHOD, AND COMPUTER PROGRAM PRODUCT

CROSS-REFERENCE TO RELATED APPLICATIONS

The present application claims priority to and incorporates by reference the entire contents of Japanese priority document 2008-130822 filed in Japan on May 19, 2008.

BACKGROUND OF THE INVENTION

1. Field of the Invention

The present invention relates to a technology for stacking sheets in an image forming apparatus.

2. Description of the Related Art

With a wide spread of an image forming apparatus, such as a copier, a printer, a facsimile (FAX), and a digital multifunction product (MFP), there are cases where a large number of sheets are discharged from the image forming apparatuses. The sheets include a recording paper, a transferring paper, an overhead projector (OHP) transparency, a sheet-type recording media, etc. A typical discharge tray that receives discharged sheets is configured to move up and down for aligning the stacked sheets according to an amount of the discharged sheets stacked thereon. If a large number of stacked sheets are removed from the discharge tray, a distance between a discharge port from which the sheet is discharged and a top of the sheets stacked on the discharge tray is increased. Then, when the next sheet is discharged, the sheet falls from the discharge port onto the discharge tray by the distance, and may disadvantageously cause the stacked sheets to be misaligned. To prevent such cases, the discharge tray is required to move up immediately when a large number of stacked sheets are removed from the discharge tray.

Most conventional discharge trays requiring a large load use a direct current (DC) brush motor as a driving source. In DC motors, a rotational speed is inversely proportional to an amount of the load. Therefore, in most cases, a control of the driving speed is not performed when using the DC motor as the driving source.

In the discharge tray without the control of the driving speed, a moving-up time is variable depending on the number of the stacked sheets, which causes an adverse effect in performance of sheet processing. Various technologies for solving the problem have been disclosed for far.

For example, Japanese Patent Application Laid-open No. 2005-170578 discloses a technology to correctly move the discharge tray up to a stand-by position in a short time after a large amount of stacked sheets is removed from the discharge tray, thereby maintaining productivity of the image forming apparatus. Japanese Patent Application Laid-open No. 2005-170578 discloses a post-processing apparatus that receives a sheet from the image forming apparatus, post-processes the sheet, and discharges the post-processed sheet onto the discharge tray. The post-processing apparatus includes a first detecting unit that detects the stand-by position of the discharge tray; a second detecting unit that detects a position of the top of the stacked sheets, selects a switching position at which the moving speed of the discharge tray is to be switched according to the detected top-surface position; a driving unit that moves the discharge tray at the variable moving speed; and a post-processing control unit that controls the driving unit at a variable speed. The post-processing control unit controls the moving speed of the discharge tray via the driving unit based on a result of the detection by the second detecting unit.

Japanese Patent Application Laid-open No. 2000-177911 discloses a sheet stacking device including a plurality of sheet stacking units with a simple and cost-reduced mechanism for detecting a paper-full state etc. The sheet stacking device includes a movable first sheet stacking unit provided, as a unit, with an end fence for aligning a trailing end of the stacked sheets in a sheet discharging direction; a full-state detecting unit that detects whether the first sheet stacking unit supports a maximum amount of the sheets; a movable second sheet stacking tray capable of receiving a large amount of sheets; and a height detecting unit that detects a position of the top of the sheets stacked on the second sheet stacking tray. The first sheet stacking tray and the second sheet stacking tray moves independently. The full-state detecting unit and the height detecting unit share at least a relevant part thereof.

In the technology disclosed in Japanese Patent Application Laid-open No. 2005-170578, the switching position is set to the position of the top of the sheets stacked on the discharge tray. The object of this technology is just to increase accuracy of a stop position at which the discharge tray stops by decreasing the moving speed immediately before the discharge tray stops. The technology disclosed in Japanese Patent Application Laid-open No. 2000-177911 is related to the sheet stacking device including the sheet stacking units with the full-state detecting unit and the height detecting unit, both used for controlling up or down movement of the sheet stacking units, sharing at least a relevant part. That is, this technology is not directly related to control of up or down movement of the sheet stacking units.

If the DC motor is used as the driving source of the sheet stacking tray, the DC motor automatically decreases, from the nature of the DC motor as described above, the moving speed of the sheet stacking tray to the low value in a highly loaded state. However, the DC brush motor has disadvantages in a short lifetime and a high frequency of maintenance. Moreover, because the driving speed fluctuates according to the amount of the sheets stacked on the discharge tray, a complicated control system is required to align the stacked sheets with high accuracy.

In contrast, brushless motors have a long lifetime. The brushless motors have received attentions as the driving motor of the sheet stacking tray, recently. However, because the rotational speed of the brushless motor does not automatically decrease in the highly loaded state, it is necessary, if the brushless motor is used as the motor that moves the stacking tray up and down, to run the brushless motor at a high speed corresponding to a maximum load expected to be generated when the stacking tray supports the maximum amount of the sheets. Usage of the high-performance motor leads up-sizing and a cost increase of the motor as the driving unit. Moreover, the high-speed revolution leads an increase of noise.

SUMMARY OF THE INVENTION

It is an object of the present invention to at least partially solve the problems in the conventional technology.

According to one aspect of the present invention, there is provided a sheet stacking device including a sheet stacking unit that stacks sheets thereon and that is movable up and down; a lifting unit that moves the sheet stacking unit up and down; a driving unit that drives the lifting unit; a control unit that controls a driving speed of the driving unit; and a position detecting unit that detects a position of the sheet stacking unit in an up-and-down direction. The control unit controls the driving speed according to the position of the sheet stacking unit detected by the position detecting unit.

Furthermore, according to another aspect of the present invention, there is provided a method of controlling a sheet stacking device including a sheet stacking unit that stacks sheets thereon and that is movable up and down, a lifting unit that moves the sheet stacking unit up and down, a driving unit that drives the lifting unit, a control unit that controls a driving speed of the driving unit, and a position detecting unit that detects a position of the sheet stacking unit in an up-and-down direction. The method includes controlling the driving speed according to the position of the sheet stacking unit detected by the position detecting unit.

Moreover, according to still another aspect of the present invention, there is provided a computer program product including a computer-usable medium having computer-readable program codes embodied in the medium for controlling a sheet stacking device including a sheet stacking unit that stacks sheets thereon and that is movable up and down, a lifting unit that moves the sheet stacking unit up and down, a driving unit that drives the lifting unit, a control unit that controls a driving speed of the driving unit, and a position detecting unit that detects a position of the sheet stacking unit in an up-and-down direction. The program codes when executed cause a computer to execute controlling the driving speed according to the position of the sheet stacking unit detected by the position detecting unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
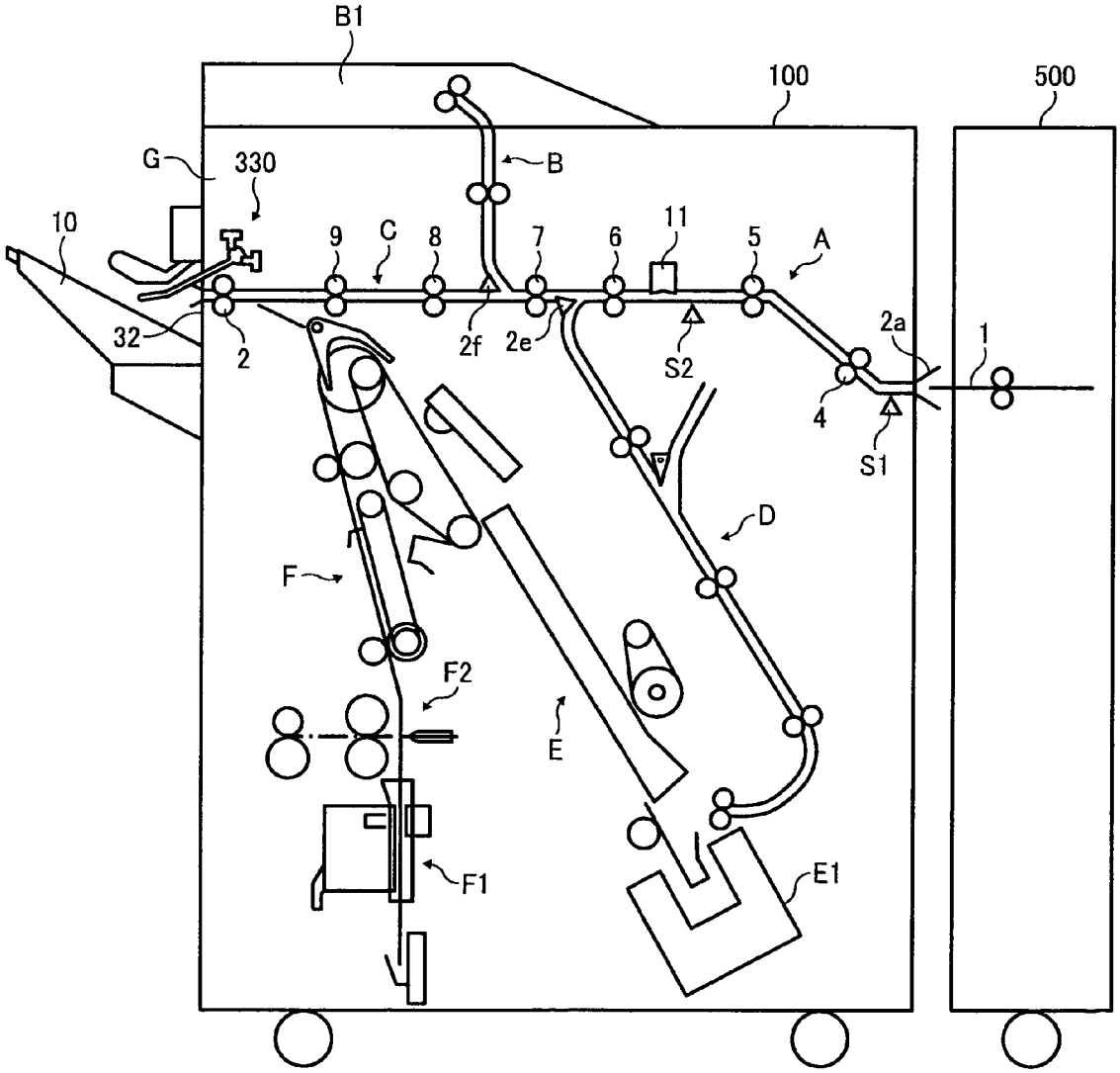
FIG. 1 is an image forming system including a sheet post-processing apparatus and an image forming apparatus according to a first embodiment of the present invention.

FIG. 1 is an image forming system including a sheet post-processing apparatus 100 and an image forming apparatus 500 according to a first embodiment of the present invention. The sheet post-processing apparatus 100 includes an entrance conveying path A, an upper conveying path B, a sheet discharging path C, a staple-unit conveying path D, a side-stitch tray E, a saddle-stitch tray F, and a stacking-tray discharging path G. After an image is formed on a sheet in the image forming apparatus 500, the sheet post-processing apparatus 100 receives the sheet from the image forming apparatus 500, post-processes the sheet, and discharges the post-processed sheet onto either a discharge tray (hereinafter, "stacking tray") 10 or a proof tray B1 (not shown). Alternatively, the sheet post-processing apparatus 100 can discharge the sheet without post-processing the sheet. The staple-unit conveying path D is a path via which the sheet is conveyed to the side-stitch tray E. The staple-unit conveying path D includes a pre-stack conveying path. The single sheet or a set of the sheets pre-stacked on a job basis (hereinafter, "sheet set") is conveyed to the side-stitch tray E via the staple-unit conveying path D. The side-stitch tray E aligns the sheet set, and conveys the aligned sheet set to the saddle-stitch tray F. Alternatively, the side-stitch tray E aligns the sheet set, staples a side position of the aligned sheet set with a side-stitch stapler E1, and discharges the stapled sheet set via the sheet discharging path C onto the stacking tray 10.

Upon receiving the sheet set, the saddle-stitch tray F aligns the sheet set again, and staples a center position of the aligned sheet set with a saddle-stitch stapler F1. After stapled, the sheet set is moved up in such a manner that a line to be folded is aligned with an edge of a folding plate. The sheet set is then half-folded by a half-folding unit F2, and the half-folded sheet set is discharged out of the sheet post-processing apparatus 100.

A feeding mechanism that feeds the sheet, a stapling mechanism, and a saddle-stitch mechanism are not featured in the first embodiment, and well-known mechanisms are used as those mechanisms. Therefore, a detail description about those mechanisms is not made.

It is clear from FIG. 1 that the sheet post-processing apparatus 100 is attached to a side surface of the image forming apparatus 500. A sheet 1, after discharged out of the image forming apparatus 500, enters the sheet post-processing apparatus 100 passing through a receiving port 2*a*. The sheet 1 is then detected by an entrance sensor S1, and conveyed inward by pairs of sheet feeders 4, 5, and 6. After that, the sheet 1 is conveyed by a pair of sheet feeder 7 and by swings of switching claws 2*e* and 2*f* to the sheet discharging path C, and further conveyed by pairs of sheet feeders 8 and 9 out onto the stacking tray 10. The switching claws 2*e* and 2*f* are switched by DC solenoids (not shown) or stepper motors (not shown). In a punch mode, a punching unit 11 punches the received the sheets one by one. During the punching operation, edges of the sheets passing through the punching unit 11 are detected by a sensor S2.

Figure 2:
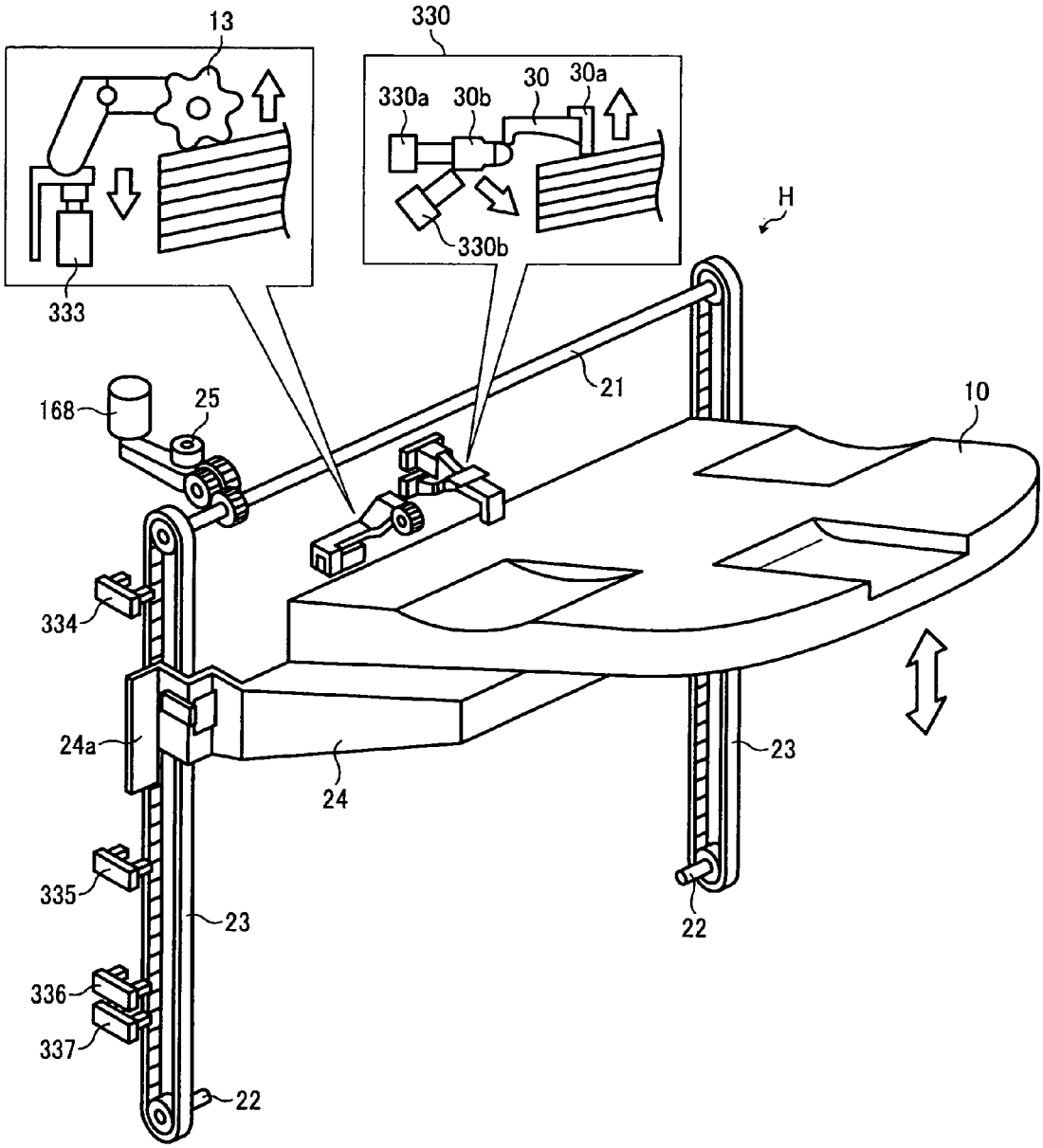
FIG. 2 is a perspective view of a lifting mechanism that lifts up and down a stacking tray shown in FIG. 1.

The stacking tray 10 is movable up and down. The stacking tray 10 is controlled to be in a predetermined stand-by position to receive the discharged sheet. FIG. 2 is a perspective view of a lifting mechanism H that lifts up and down the stacking tray 10. The stacking tray 10 moves up and down by rotation of a driving shaft 21 that is driven by a driving unit including a tray lifting motor 168 and a worm gear 25. Timing belts 23 are supported by the driving shaft 21 and a driven shaft 22 via timing pulleys (not shown). A side plate 24 that supports the stacking tray 10 is fixed to the timing belts 23. With this configuration, the stacking tray 10 and the relevant parts are suspended movably up and down. A brushless motor is used as the tray lifting motor 168. It is needless to say that it is used the brushless motor, although any type of the brushless motor can be used, capable of lifting up the stacking tray 10 even when the stacking tray 10 supports the maximum amount of the stacked sheets.

The tray lifting motor 168 can generate both a positive driving force and a negative driving force. The driving force generated by the tray lifting motor 168 is transmitted via the worm gear 25 to the last one of a series of gears attached to the driving shaft 21. Thus, the driving unit moves the stacking tray 10 up and down. The presence of the worm gear 25 allows the driving unit to maintain the stacking tray 10 at a fixed position, and prevents a sudden fall-down of the stacking tray 10.

The side plate 24 of the stacking tray 10 and a shielding plate 24*a* are formed as a unit. A first position sensor 334, a second position sensor 335, a third position sensor 336, and a fourth position sensor 337 are arranged along a direction in which the shielding plate 24*a* moves. The position sensors 334 to 337 are turned ON and OFF by the position of the shielding plate 24*a*, thereby detecting the position of the stacking tray 10. The position sensors 334 to 337 are arranged in this order, with the first position sensor 334 being the highest.

The stacking-tray discharging path G, which is arranged most-downstream of the sheet post-processing apparatus 100, is formed with a pair of stacking-tray discharging rollers 2, a reverse roller 13, a sheet sensor unit 330, the stacking tray 10, a shifting mechanism (not shown), and the lifting mechanism H.

The reverse roller 13 is made of sponge. When the sheet is discharged by the stacking-tray discharging rollers 2, the reverse roller 13 comes in contact with the sheet so that the trailing end of the sheet abuts against an end fence 32, which makes the sheets stacked on the stacking tray 10 aligned. The reverse roller 13 is rotated by the rotation of the stacking-tray discharging rollers 2. There is a lift-up stop switch 333 near the reverse roller 13. When the moving-up stacking tray 10 pushes the reverse roller 13 up, the lift-up stop switch 333 turns ON and the tray lifting motor 168 stops. Thus, the stacking tray 10 cannot move up beyond a predetermined position. The sheet sensor unit 330 is arranged near the reverse roller 13. The sheet sensor unit 330 detects a position of the top of the sheet(s) stacked on the stacking tray 10.

The sheet sensor unit 330 includes a sheet detection lever 30, a stapled sheet sensor 330*a*, and a non-stapled sheet sensor 330*b*. The sheet detection lever 30 is rotatable around the center point of a shaft thereof. The sheet detection lever 30 includes a contact member 30*a* that comes in contact with the trailing end of the top of the sheet(s) stacked on the stacking tray 10, and a fan-shaped shielding member 30*b*. The stapled sheet sensor 330*a* is arranged above the non-stapled sheet sensor 330*b*. The stapled sheet sensor 330*a* is used for sheet discharge control for stapled sheets. The non-stapled sheet sensor 330*b* is used for sorting.

The stapled sheet sensor 330*a* is turned ON when the stapled sheet sensor 330*a* is behind the shielding member 30*b*. The non-stapled sheet sensor 330*b* is turned ON when the non-stapled sheet sensor 330*b* is behind the shielding member 30*b*. Therefore, when the stacking tray 10 moves up and the sheet detection lever 30 swings upward together with the contact member 30*a*, the stapled sheet sensor 330*a* is turned OFF. When the sheet detection lever 30 swings upward further, the non-stapled sheet sensor 330*b* is turned ON. When it is determined using the stapled sheet sensor 330*a* and the non-stapled sheet sensor 330*b* that the position of the top of the stacked sheets reaches a predetermined height, the stacking tray 10 moves down by a predetermined amount by the driving of the tray lifting motor 168 so that the position of the top of the stacked sheets is always at the substantially same level.

Figure 3:
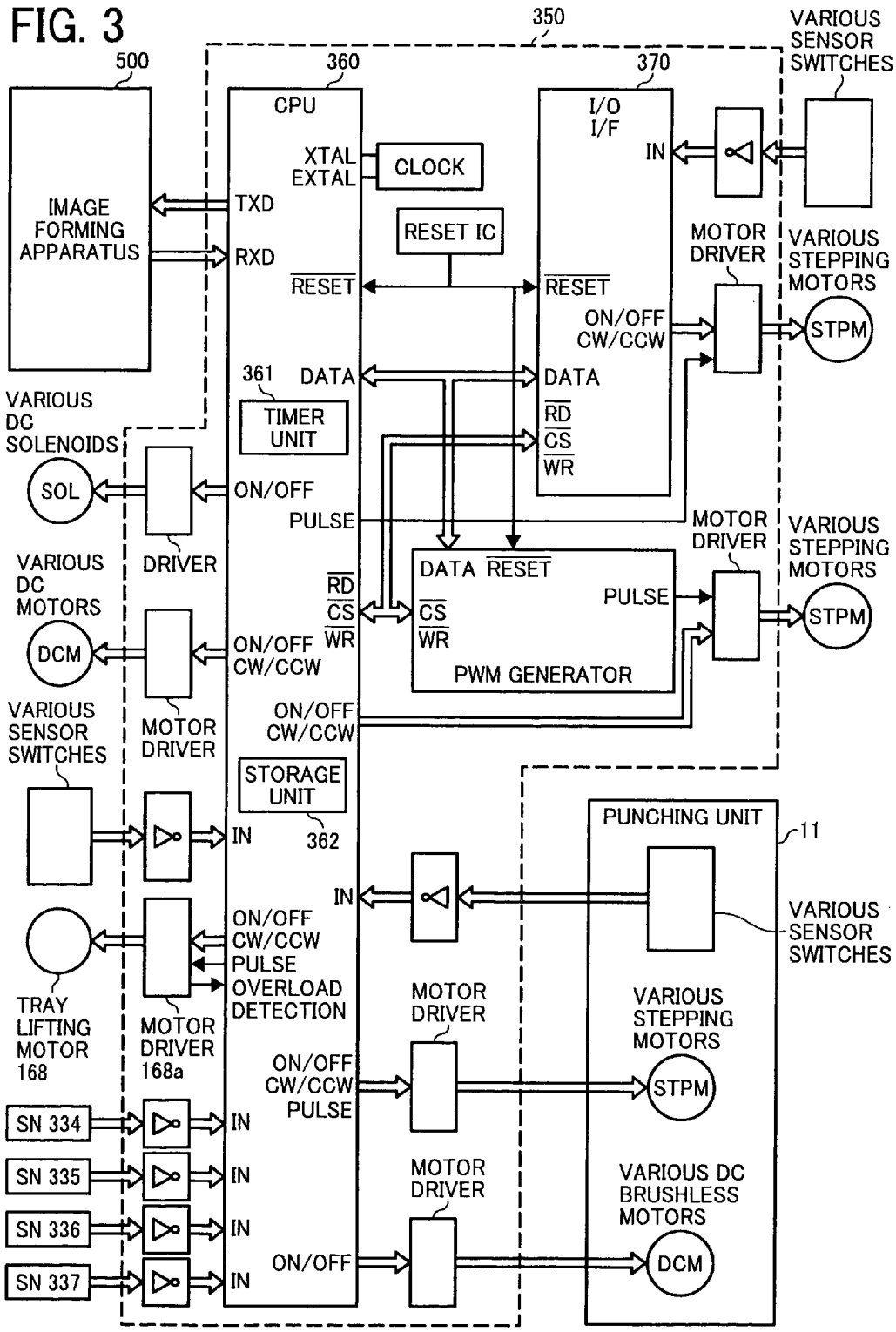
FIG. 3 is a block diagram of control configuration of the sheet post-processing apparatus and relevant parts.

FIG. 3 is a block diagram of control configuration of the sheet post-processing apparatus 100 and relevant parts. A control device 350 of the sheet post-processing apparatus 100 includes a CPU 360 and an input/output (I/O) interface (I/F) 370. The CPU 360 sends/receives various commands and data to/from the image forming apparatus 500. To move the stacking tray 10 up, the CPU 360 sends an ON signal, a clockwise/counter-clockwise (CW/CCW) signal, and a pulse to a motor driver 168*a*. A frequency of the pulse decides the rotational speed of the tray lifting motor 168. When the stacking tray 10 moves up, the CPU 360 reads values from the position sensors 334, 335, 336, and 337, and detects the position of the stacking tray 10. The CPU 360 changes the frequency of the pulse, and sends the pulse with the changed frequency so that the tray lifting motor 168 runs at the speed variable according to the detected position.

The CPU 360 includes a timer unit 361 and a storage unit 362. The CPU 360 sends control signals to drivers of various DC solenoids, drivers of various DC motors, and drivers of various stepper motors; receives detection signals from various sensors via interfaces; and sends/receives signals and data to/from a pulse-wide modulation (PWM) generator and the I/O I/F 370. The CPU 360 includes a read only memory (ROM) and a random access memory (RAM) (both not shown). The CPU 360 reads program codes from the ROM, loads the program codes on the RAM as a work area, and executes the program codes, thereby performing control defined by the program codes. The program codes are included in a computer program. The computer program can be read by a computer including a CPU mounted on a control circuit from a recording medium, or can be downloaded via a network to the computer.

Control of movement of the stacking tray 10 is described below. In the following embodiments, the same parts are denoted with the same reference numerical, and the same description is not repeated.

Figure 4:
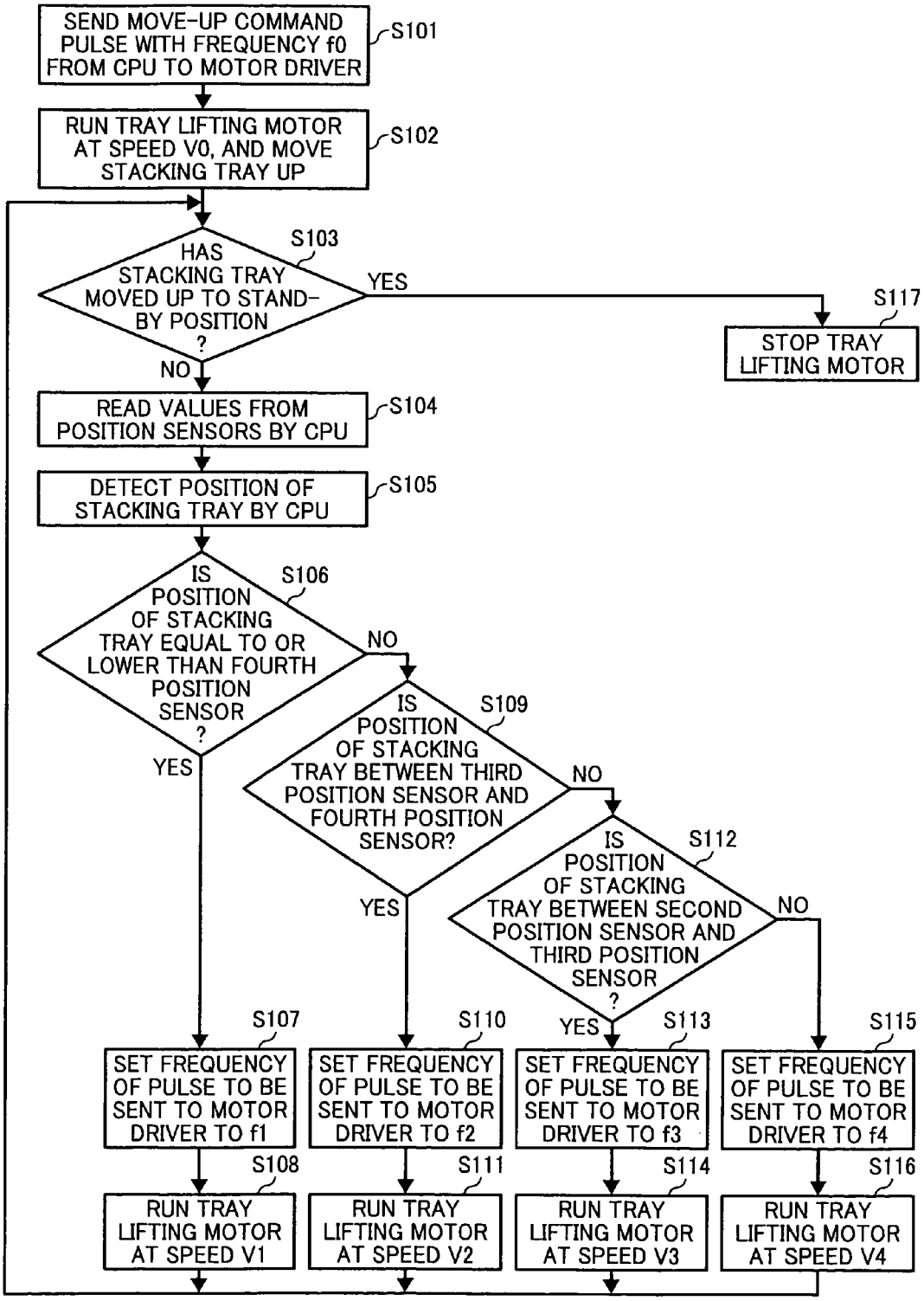
FIG. 4 is a flowchart of a process of controlling a driving speed of a tray lifting motor by referring to a position of the stacking tray according to the first embodiment.

FIG. 4 is a flowchart of a process of controlling the driving speed of the tray lifting motor 168 by referring to the position of the stacking tray 10 according to the first embodiment. In the process, the position of the stacking tray 10 is detected by the position sensors 334, 335, 336, and 337. SN shown in the drawings indicates "sensor".

The CPU 360 sends the ON signal, the CW/CCW signal, and the pulse with a frequency f0 to move the stacking tray 10 up (Step S101). The tray lifting motor 168 runs at a speed V0, and thus the stacking tray 10 moves up (Step S102). The CPU 360 determines whether the stacking tray 10 has moved up to the stand-by position (Step S103). If the stacking tray 10 has moved up to the stand-by position (Yes at Step S103), the CPU 360 stops the tray lifting motor 168 (Step S117). Thus, the stacking tray 10 stops at the stand-by position. The stand-by position is a position where the sheet sensor unit 330 detects the top of the stacked sheets or, if no sheet is stacked, the top of the stacking tray 10. As described above, the stand-by position is slightly variable by mode.

If the stacking tray 10 has not moved up to the stand-by position (No Step S103), the CPU 360 reads the values from the position sensors 334, 335, 336, and 337 (Step S104), and detects the position of the stacking tray 10 (Step S105). The position of the stacking tray 10 is detected in comparison with reference positions including the lowest position of the fourth position sensor 337, the second lowest position of the third position sensor 336, the third lowest position of the second position sensor 335, and the highest position of the first position sensor 334. If the detected position of the stacking tray 10 is equal to or lower than the fourth position sensor 337 (Yes at Step S106), the CPU 360 sets the frequency of the pulse to be sent to the motor driver 168*a* to f1 (Step S107) so that the tray lifting motor 168 runs at a speed V1 (Step S108). The process control returns to Step S103.

If the detected position of the stacking tray 10 is between the fourth position sensor 337 and the third position sensor 336 (Yes at Step S109), the CPU 360 sets the frequency of the pulse to be sent to the motor driver 168*a* to f2 (Step S110) so that the tray lifting motor 168 runs at a speed V2 (Step S111). The process control returns to Step S103.

If the detected position of the stacking tray 10 is between the third position sensor 336 and the second position sensor 335 (Yes at Step S112), the CPU 360 sets the frequency of the pulse to be sent to the motor driver 168*a* to f3 (Step S113) so that the tray lifting motor 168 runs at a speed V3 (Step S114). The process control returns to Step S103.

If the detected position of the stacking tray 10 is higher than the second position sensor 335 (No at Step S112), the CPU 360 sets the frequency of the pulse to be sent to the motor driver 168*a* to f4 (Step S115) so that the tray lifting motor 168 runs at a speed V4 (Step S116). The process control returns to Step S103. The first position sensor 334 works as an upper limit sensor; and the fourth position sensor 337 works as a lower limit sensor.

In this manner, when the position of the stacking tray 10 is within any of the area equal to lower than the fourth position sensor 337, the area between the third position sensor 336 and the fourth position sensor 337, and the area between the second position sensor 335 and the third position sensor 336 (Steps S106, S109, and S112), the CPU 360 issues the pulse with the corresponding frequency f1, f2, f3, or f4 according to the position of the stacking tray 10 (Steps S107, S110, S113, and S115). The tray lifting motor 168 runs at the corresponding speed V1, V2, V3, or V4 according to the frequency (Steps S108, S111, S114, and S116), and the process control returns to the determination whether the stacking tray 10 has moved up to the stand-by position (Step S103). Those steps are repeated until the stacking tray 10 has moved up to the stand-by position.

To cause the tray lifting motor 168 run at the proper rotational speed, a relation among the speeds V0, V1, V2, V3, and V4 is preferably set as follows:

$$V0 \leqq V1 \leqq V2 \leqq V3 \leqq V4$$

That is, the higher the position of the stacking tray 10 is, the higher speed the tray lifting motor 168 runs at. This is because it is considered that the higher the position of the stacking tray 10 is, the less the stacked sheet is. Suppose, for example, a case where a small amount of the sheets is removed from the stacking tray 10 that is located at a low position. Because an amount of the stacked sheets is still large, if the driving speed of the tray lifting motor 168 is too high, the tray lifting motor 168 will be overloaded.

To improve accuracy at which the stacking tray 10 can stop at the target stop position, it is allowable to decrease the speed when the stacking tray 10 moves up beyond the fourth position sensor 337. In this case, the relation among the speeds V0, V1, V2, V3, and V4 is set as follows:

$$V4 \leqq V0 \leqq V1 \leqq V2 \leqq V3$$

Figure 5:
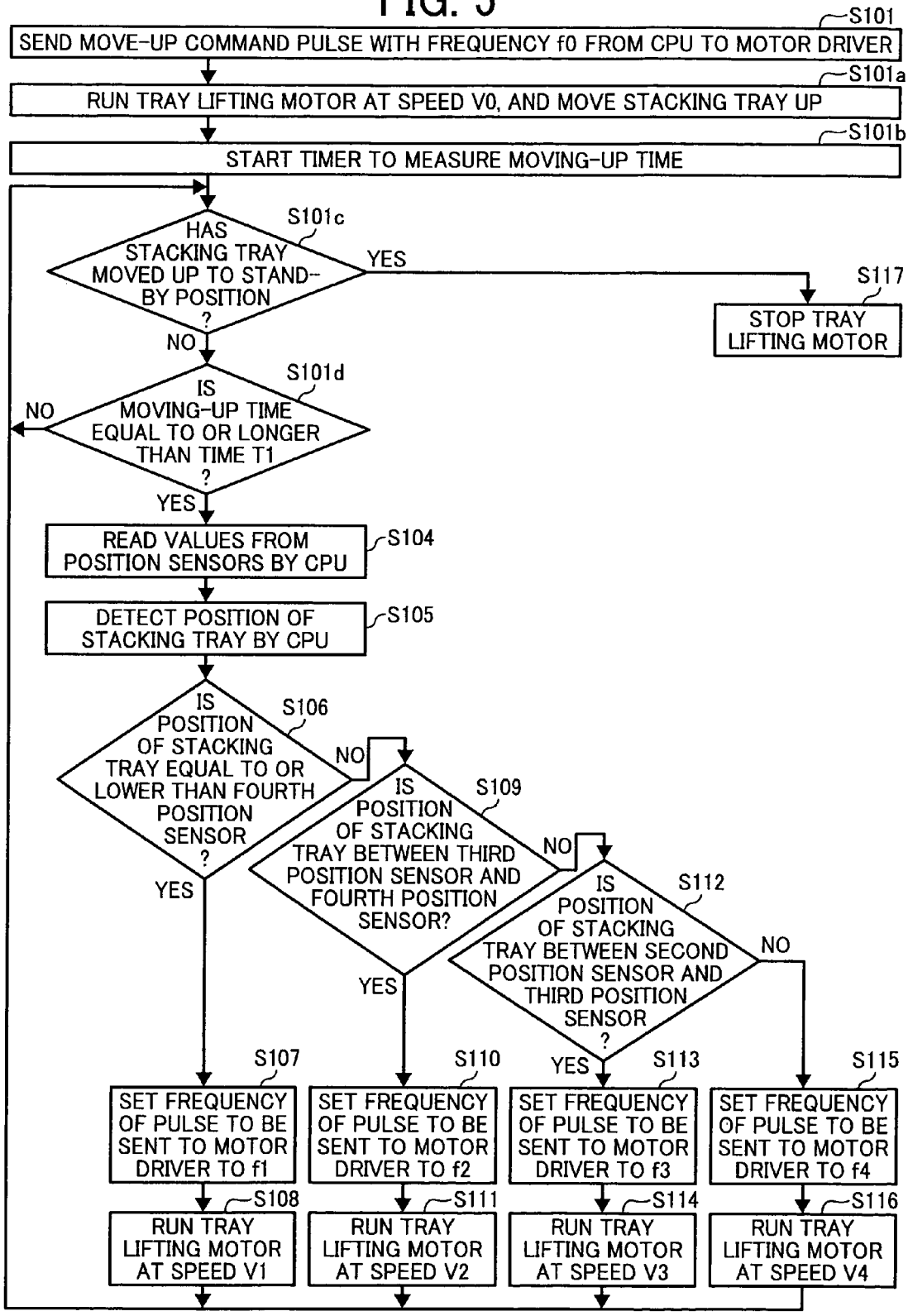
FIG. 5 is a flowchart of a process of controlling the tray lifting motor according to a second embodiment of the present invention, in which the driving speed is controlled only when a moving-up time of the stacking tray is equal to or longer than a threshold.

FIG. 5 is a flowchart of a process of controlling the tray lifting motor 168 according to a second embodiment of the present invention, in which the driving speed is controlled only when the moving-up time of the stacking tray 10 is equal to or longer than a threshold. In other words, if the moving-up operation has been completed within a predetermined time, the driving speed control process, which is described in the first embodiment, is not performed.

The CPU 360 sends the ON signal, the CW/CCW signal, and the pulse with the frequency f0 to move the stacking tray 10 up (Step S101). The tray lifting motor 168 runs at the speed V0, and thus the stacking tray 10 moves up (Step S101*a*). The CPU 360 starts the timer unit 361 to measure the moving-up time (Step S101*b*). The CPU 360 determines whether the stacking tray 10 has moved up to the stand-by position (Step S101*c*). If the stacking tray 10 has moved up to the stand-by position (Yes at Step S101*c*), the CPU 360 stops the tray lifting motor 168 (Step S117). If the stacking tray 10 has not moved up to the stand-by position (No Step S101*c*), the CPU 360 determines whether the moving-up time is equal to or longer than a predetermined time T1 (Step S101*d*). If the moving-up time is shorter than the time T1 (No at Step S101*d*), the process control returns to the process at Step S101*c* of determining whether the stacking tray 10 has moved up to the stand-by position. If the stacking tray 10 has moved up to the stand-by position, which is the target position detected by the sheet sensor unit 330, within the time T1, the CPU 360 stops the tray lifting motor 168 skipping the processes at Step S104 and the subsequent steps (Step S117).

If the moving-up time is equal to longer than the time T1 (Yes at Step S101*d*), i.e., if the stacking tray 10 cannot move up to the stand-by position within the time T1, the processes from Step S104 to Step S116 are performed in the same manner as in the first embodiment, and the process control returns to the process at Step S101*c* of determining whether the stacking tray 10 has moved up to the stand-by position. The processes at Step S101*d* and the subsequent steps are repeated until the stacking tray 10 has moved up to the stand-by position. When the stacking tray 10 has moved up to the stand-by position, the CPU 360 stops the tray lifting motor 168 (Step S117).

Although the time T1 used at Step S101*d* can be set to an arbitrary time, the time T1 is set to a time that it takes for the stacking tray 10 to move up by a maximum distance for the sheet discharging, i.e., a distance between the lower-limit position and the stand-by position in the second embodiment. Because the time that it takes for the stacking tray 10 to move by the distance between the lower-limit position and the stand-by position is variable depending on the driving properties of the tray lifting motor 168 including the moving speed and the acceleration speed, the appropriate time T1 is variable on a device-to-device basis.

Figure 6A:
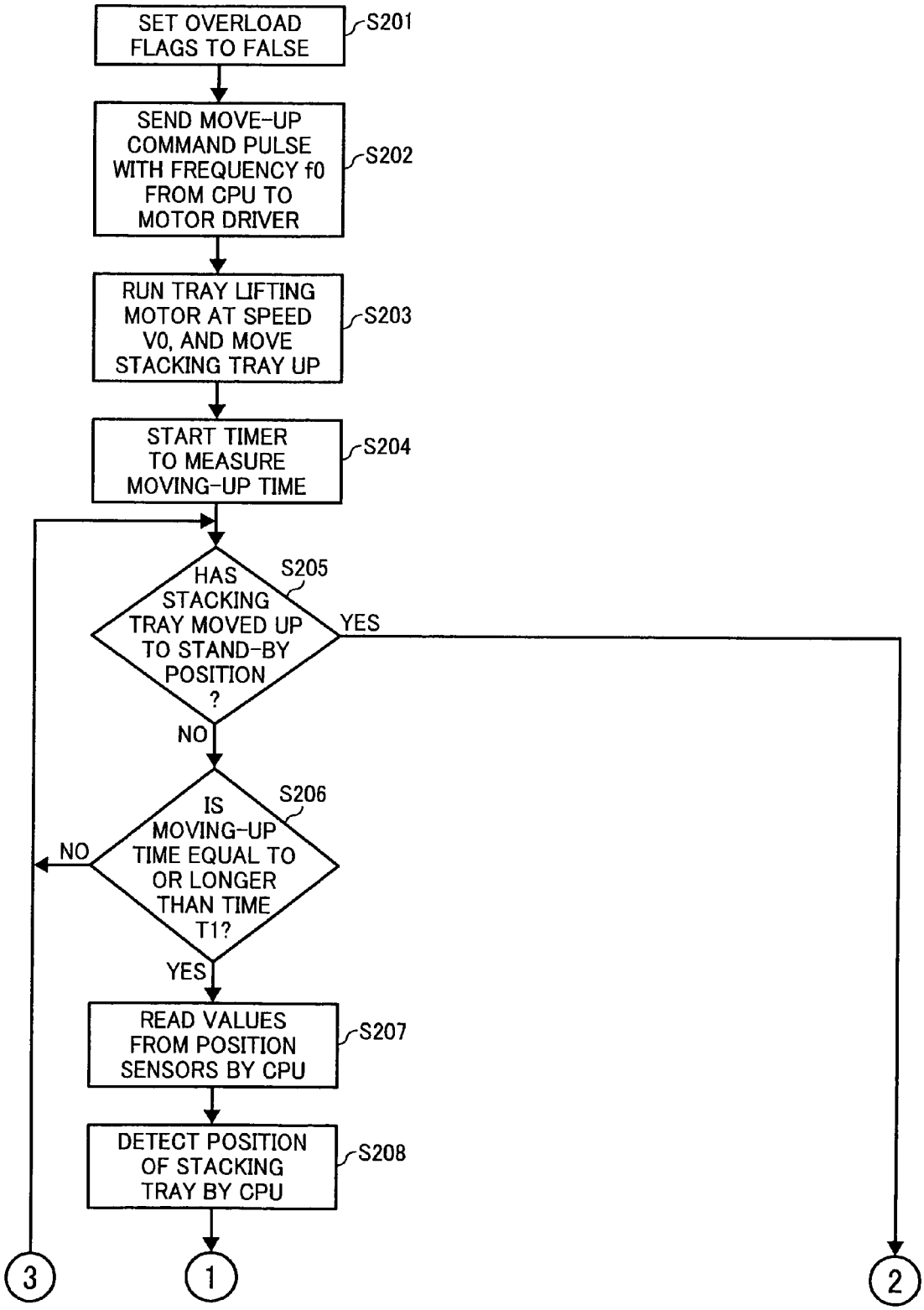
FIGS. 6A to 6C are a flowchart of a process of controlling the tray lifting motor according to a third embodiment of the present invention, in which if it is detected that the tray lifting motor running at a specified speed is overloaded, the driving speed is adjusted.
Figure 6B:
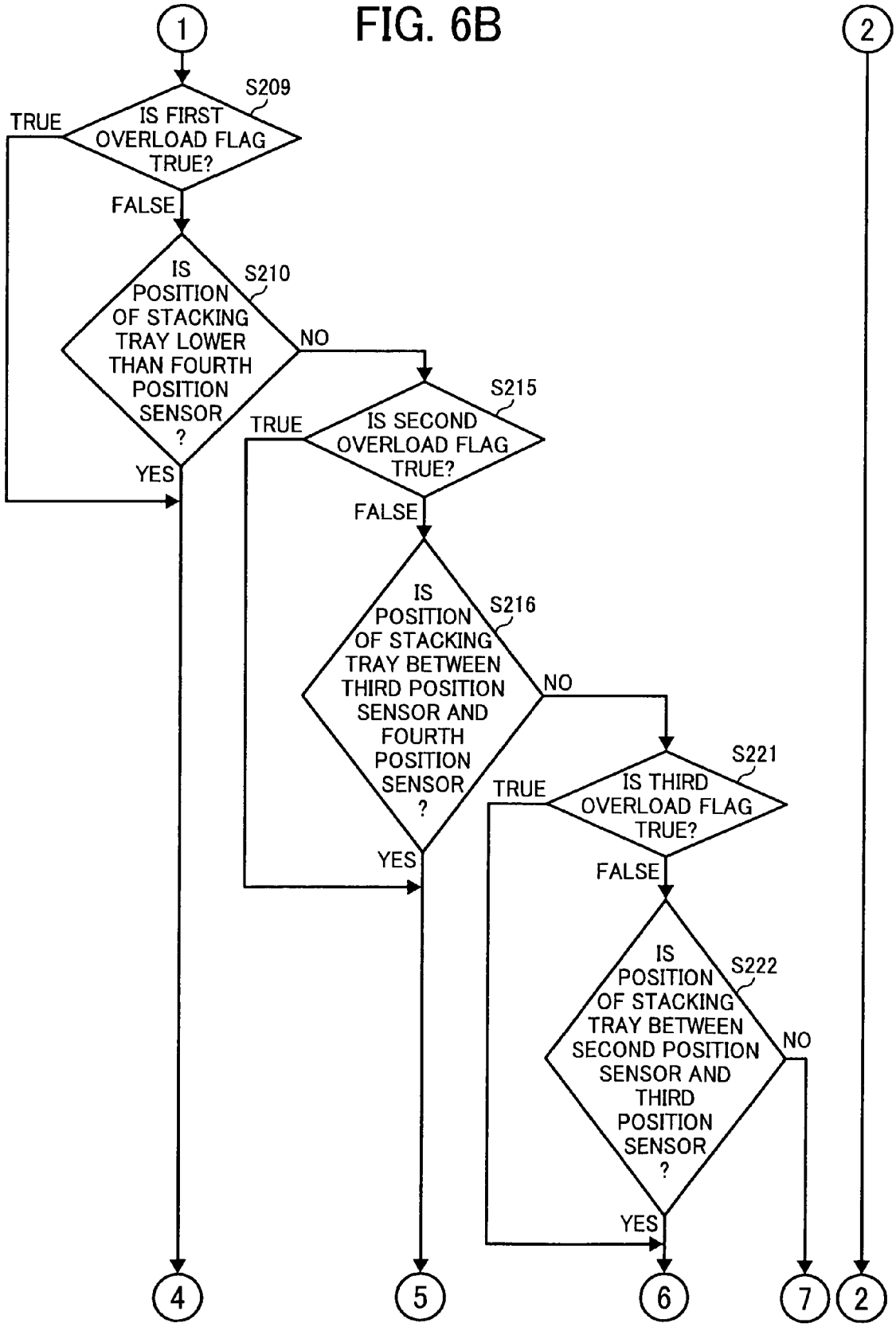
Figure 6C:
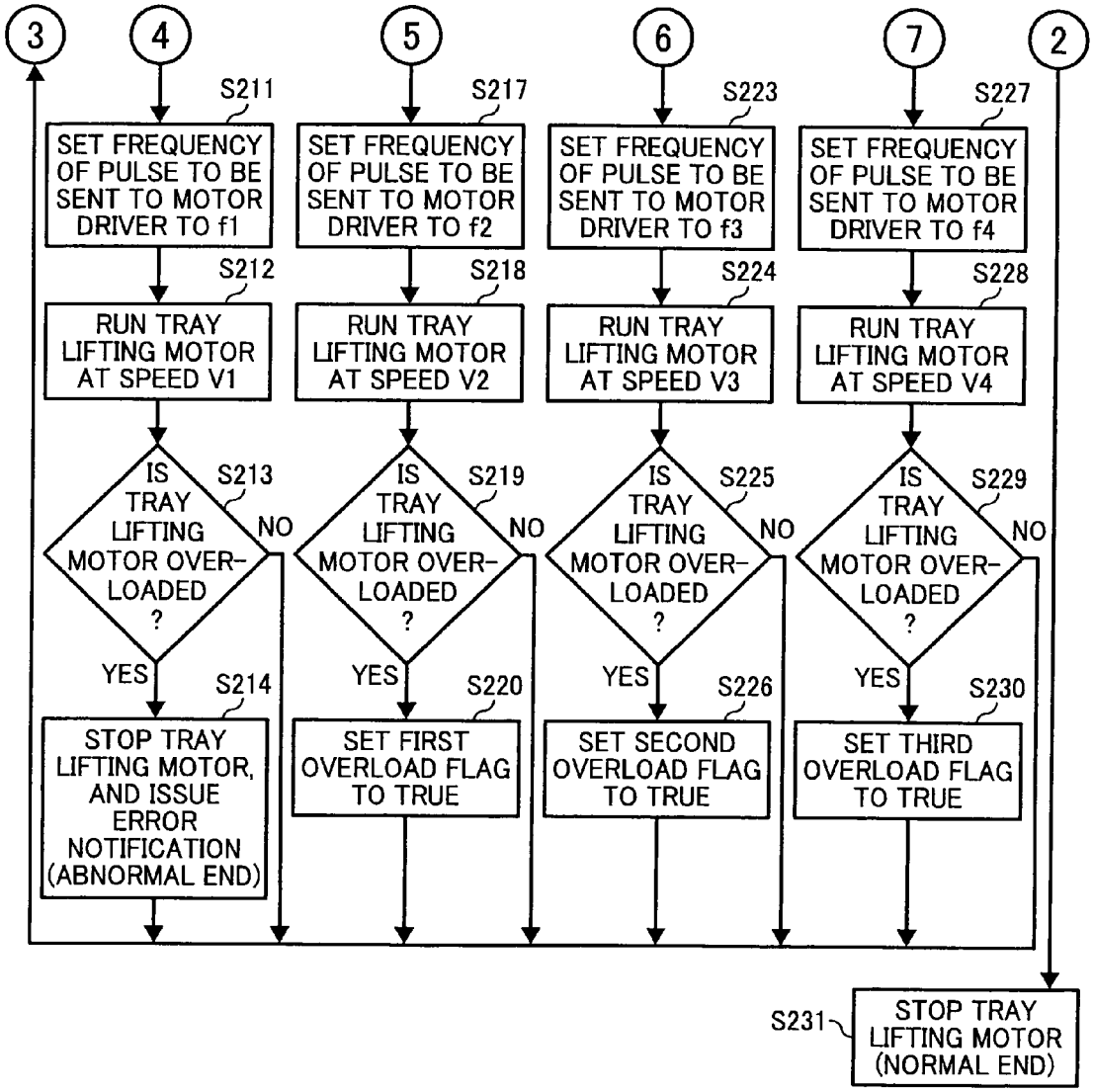

FIGS. 6A to 6C are a flowchart of a process of controlling the tray lifting motor 168 according to a third embodiment of the present invention, in which if it is detected that the tray lifting motor 168 running at the specified speed is overloaded, the driving speed is adjusted. FIG. 6B is a continuation of the flowchart shown in FIG. 6A; FIG. 6C is a continuation of the flowchart shown in FIG. 6B. The CPU 360 sets a first overload flag OVLF2, a second overload flag OVLF3, and a third overload flag OVLF4 that arranged in the storage unit 362 to false (Step S201). The overload flags OVLF2, OVLF3, and OVLF4 are corresponding to the position of the stacking tray 10 that is detected by using the position sensors 334, 335, 336, and 337. The CPU 360 sends the ON signal, the CW/CCW signal, and the pulse with the frequency f0 to move the stacking tray 10 up (Step S202). The tray lifting motor 168 runs, under control of the CPU 360 with those signals and the pulse, at the speed V0, and thus the stacking tray 10 moves up (Step S203).

The CPU 360 starts the timer unit 361 to measure the moving-up time (Step S204), and determines whether the stacking tray 10 moves up the stand-by position (Step S205). If the stacking tray 10 has moved up to the stand-by position (Yes at Step S205), the CPU 360 stops the tray lifting motor 168 because it is unnecessary to move the stacking tray 10 up higher (Step S231). If the stacking tray 10 has not moved up to the stand-by position (No Step S205), the CPU 360 determines whether the moving-up time is equal to or longer than the time T1 (Step S206). The time T1 is described in the second embodiment. If the moving-up time is shorter than the time T1 (No at Step S206), the process control returns to the process at Step S205 of determining whether the stacking tray 10 has moved up to the stand-by position, and the processes at Step S205 and the subsequent steps are repeated. On the other hand, if the moving-up time is equal to or longer than the time T1 (Yes at Step S205), the CPU 360 reads the values from the position sensors 334, 335, 336, and 337 (Step S207), and detects the position of the stacking tray 10 (Step S208).

After detecting the position of the stacking tray 10, the CPU 360 checks a status of the first overload flag OVLF2 (Step S209). If the first overload flag OVLF2 is true (True at Step S209), the CPU 360 sets the frequency of the pulse to be sent to the motor driver 168*a* to f1 without performing the determination about the position of the stacking tray 10 (Step S211) so that the tray lifting motor 168 runs at the speed V1 (Step S212). On the other hand, if the first overload flag OVLF2 is false (False at Step S209), the CPU 360 determines whether the detected position of the stacking tray 10 is equal to or lower than the fourth position sensor 337 (Step S210). If the detected position of the stacking tray 10 is equal to or lower than the fourth position sensor 337 (Yes at Step S210), processes at Step S211 and the subsequent steps are performed. If the detected position of the stacking tray 10 is higher than the fourth position sensor 337 (No at Step S210), the CPU 360 checks a status of the second overload flag OVLF3 (Step S215).

If the second overload flag OVLF3 is true (True at Step S215), the CPU 360 sets the frequency of the pulse to be sent to the motor driver 168*a* to f2 without performing the determination about the position of the stacking tray 10 (Step S217) so that the tray lifting motor 168 runs at the speed V2 (Step S218). On the other hand, if the second overload flag OVLF3 is false (False at Step S215), the CPU 360 determines whether the detected position of the stacking tray 10 is between the third position sensor 336 and the fourth position sensor 337 (Step S216). If the detected position of the stacking tray 10 is between the third position sensor 336 and the fourth position sensor 337 (Yes at Step S216), processes at Step S217 and the subsequent steps are performed. If the detected position of the stacking tray 10 is not between the third position sensor 336 and the fourth position sensor 337 (No at Step S216), the CPU 360 checks a status of the third overload flag OVLF4 (Step S221).

If the third overload flag OVLF4 is true (True at Step S221), the CPU 360 sets the frequency of the pulse to be sent to the motor driver 168*a* to f3 without performing the determination about the position of the stacking tray 10 (Step S223) so that the tray lifting motor 168 runs at the speed V3 (Step S224). On the other hand, if the third overload flag OVLF4 is false (False at Step S221), the CPU 360 determines whether the detected position of the stacking tray 10 is between the second position sensor 335 and the third position sensor 336 (Step S222). If the detected position of the stacking tray 10 is between the second position sensor 335 and the third position sensor 336 (Yes at Step S222), processes at Step S223 and the subsequent steps are performed. If the detected position of the stacking tray 10 is not between the second position sensor 335 and the third position sensor 336 (No at Step S222), the CPU 360 sets the frequency of the pulse to be sent to the motor driver 168*a* to f4 (Step S227) so that the tray lifting motor 168 runs at the speed V4 (Step S228).

After the tray lifting motor 168 runs at the specified speed (Steps S212, S218, S224, and S228), the CPU 360 reads an overload-state signal from the motor driver 168*a* (Steps S213, S219, S225, and S229). If the CPU 360 detects that the tray lifting motor 168 running at the specified speed V1 is overloaded (Yes at Step S213), the CPU 360 determines that a system error has occurred, and stops the tray lifting motor 168. The process control goes to an error end (Step S214). If the CPU 360 detects that the tray lifting motor 168 running at the specified speed V2, V3, or V4 is overloaded (Yes at Steps S219, S225, and S229), the CPU 360 sets the corresponding one of the overload flags OVLF2, OVLF3, and OVLF4 to true (Steps S220, S226, and S230) and the process control returns to the process at Step S205.

If the process control goes to the error end at Step S214, an error notification is issued, and an error message notifying that the operation stops because the stacking tray 10 is disabled is displayed on a display panel (not shown) of the image forming apparatus 500.

Although the determination about the overload state is made at Steps S213, S219, S225, and S229 by using the function of the motor driver 168*a* including the IC for driving the tray lifting motor 168 in the third embodiment, it is allowable to detect the overload state by using some other units such as a current detection circuit instead of the motor driver 168*a*.

Although the position sensors 334, 335, 336, and 337 are used to detect the position of the stacking tray 10 in the third embodiment, it is allowable to detect the position of the stacking tray 10 with some other devices. For example, a disk encoder is installed, arranged coaxially with the driven shaft 22. An optical sensor reads rotation of the encoder to detect the position of the stacking tray 10. In another example, a plurality of line-shaped marks is formed on a back surface of the timing belt 23, aligned at equal intervals with a line of each mark running perpendicular to the rotating direction of the timing belt 23. An encoder that reads the marks by an optical sensor is used to detect the position of the stacking tray 10.

If the tray lifting motor 168 is overloaded at Step S219, the first overload flag OVLF2 is set to true at Step S220, and the processes at Step S205 and the subsequent steps are repeated. In the subsequent steps, more particularly, it is determined at Step S209 that the first overload flag OVLF2 is true. As a result, the CPU 360 sets the frequency of the pulse to be sent to the motor driver 168*a* to f1 so that the stacking tray 10 moves up by the tray lifting motor 168 with the speed decreased to V1 at Step S212. If the tray lifting motor 168 is overloaded at Steps S225 and S229, the speed of the tray lifting motor 168 is decreased in the same manner as in the processes subsequent to Yes at Step S219, by the corresponding overload flag that is set to true.

The embodiments of the present invention bring the following effects:

1. The speed of the tray lifting motor 168 is adjusted by the position of the stacking tray 10 that is detected by the position sensors 334, 335, 336, and 337, which makes it possible to implement the control of the stacking-tray driving speed according to the load. This allows downsizing and cost-reduction of the mechanism for driving the stacking tray 10 and the sheet stacking device. Moreover, the noise is reduced.

2. The speed of the tray lifting motor 168 is controlled only when the load for moving the stacking tray 10 up is large, which allows a simple control system.
3. The moving speed at which the stacking tray 10 moves up is set proportional to the position of the stacking tray 10, i.e., the moving speed is set close to an upper-limit value under the allowable loads. Therefore, the moving-up time that it takes for the stacking tray 10 to move up to the predetermined stand-by position is shortened.
4. The control of the speed at which the driving unit runs can be configured to be performed only when the successive operating time of the stacking tray 10 is equal to or longer than the threshold. If so, when the sheets are discharged in a normal mode, the movement of the stacking tray will not be controlled according to the control method. Therefore, it is possible to shorten the moving-up time immediately after the power is turned ON, a large amount of the stacked sheets is removed, etc. with maintaining stackability.
5. If it is detected that the tray lifting motor 168 running at the specified speed is overloaded, the speed of the tray lifting motor 168 is decreased. With this configuration, the tray lifting motor 168 is always driven under the allowable load.
6. If it is detected, after the speed of the tray lifting motor 168 is specified, that the tray lifting motor 168 is overloaded when the stacking tray 10 is moving up in the area lower than the fourth position sensor 337 at the corresponding speed V1, the tray lifting motor 168 is stopped and the error notification is issued. In this manner, the operation stops in an event of an excess load, a failure, etc. This implements the safer operation.
7. The accuracy at which the stacking tray 10 can stop at the target stop position can be improved, even when the moving speed of the stacking tray 10 is accelerated, by setting the speed V4 of the tray lifting motor 168 to a speed, for example, slower than the initial speed V0. The speed of the tray lifting motor 168 is set to V4 when the position of the stacking tray 10 is equal to or higher than the first position sensor 334.
8. Because the tray lifting motor 168 is a brushless motor, it is possible to provide the highly reliable sheet stacking device having a long lifetime.

According to an aspect of the present invention, it is possible to provide a smaller and less-noisy driving unit and a smaller and less-noisy sheet stacking device at a lower cost.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet stacking device comprising:

a sheet stacking unit that stacks sheets thereon and that is movable up and down;

a lifting unit that moves the sheet stacking unit up and down;

a driving unit that drives the lifting unit;

a control unit that controls a driving speed of the driving unit and determines whether a moving-up time of the sheet stacking unit is equal to or greater than a threshold; and a position detecting unit that detects a position of the sheet stacking unit in an up-and-down direction, wherein the control unit controls the driving speed according to the position of the sheet stacking unit detected by the position detecting unit if the control unit determines that the moving-up time is equal to or greater than the threshold, the control unit controls the driving speed without the detected position if the control unit determines that the moving-up time is less than the threshold.

2. The sheet stacking device according to claim 1, wherein the control unit controls the driving speed at the time of moving up the sheet stacking unit.

3. The sheet stacking device according to claim 1, wherein the position of the sheet stacking unit includes a first position and a second position, the control unit sets the driving speed corresponding to the first position to a first speed and the driving speed corresponding to the second position to a second speed, and when the first position is lower than the second position, the control unit sets the first speed equal to or slower than the second speed.

4. The sheet stacking device according to claim 1, wherein the control unit determines whether the driving unit is overloaded, and upon determining that the driving unit is overloaded after setting the driving speed to a first speed, the control unit sets the driving speed to a second speed that is slower than the first speed.

5. The sheet stacking device according to claim 1, wherein the control unit determines whether the driving unit is overloaded, the position detecting unit sets a plurality of areas according to the position of the sheet stacking unit in the up-and-down direction, and upon determining that the driving unit is overloaded when the lifting unit moves up the sheet stacking unit at a driving speed in a lowest area, the control unit stops an operation of the driving unit.

6. The sheet stacking device according to claim 5, wherein upon stopping the operation of the driving unit, the control unit issues an error notification.

7. The sheet stacking device according to claim 1, wherein the position detecting unit sets a plurality of areas according to the position of the sheet stacking unit in the up-and-down direction, and when the lifting unit moves up the sheet stacking unit to a highest area, the control unit sets the driving speed to a lowest speed.

8. The sheet stacking device according to claim 1, wherein the position detecting unit includes an optical sensor that detects either one of the position of the sheet stacking unit and a rotational position of the lifting unit.

9. The sheet stacking device according to claim 1, wherein the driving unit is formed with a brushless motor.

10. A sheet processing apparatus comprising a sheet stacking device according to claim 1.

11. An image forming apparatus comprising a sheet processing apparatus according to claim 10.

12. An image forming apparatus comprising a sheet stacking device according to claim 1.

13. A method of controlling a sheet stacking device including a sheet stacking unit that stacks sheets thereon and that is movable up and down, a lifting unit that moves the sheet stacking unit up and down, a driving unit that drives the lifting unit, a control unit that controls a driving speed of the driving unit, and a position detecting unit that detects a position of the sheet stacking unit in an up-and-down direction, the method comprising:

determining whether a moving-up time of the sheet stacking unit is equal to or greater than a threshold;

controlling the driving speed according to the position of the sheet stacking unit detected by the position detecting unit if the determining step determines that the moving-up time is equal to or greater than the threshold; and controlling the driving speed without the detected position if the determining step determines that the moving-up time is less than the threshold.

14. The method according to claim 13, wherein the controlling includes setting the driving speed by referring to a reference position in the up-and-down direction in such a manner that a driving speed corresponding to an up direction is faster and a driving speed corresponding to a down direction is slower.

15. The method according to claim 14, wherein the controlling includes setting the driving speed to a first speed, determining whether the driving unit is overloaded, and setting, when it is determined that the driving unit is overloaded after setting the driving speed to the first speed, the driving speed to a second speed that is slower than the first speed.

16. The method according to claim 14, wherein the controlling includes determining whether the driving unit is overloaded, setting a plurality of areas according to the position of the sheet stacking unit in the up-and-down direction, and stopping, when it is determined that the driving unit is overloaded when the lifting unit moves up the sheet stacking unit at a driving speed in a lowest area, an operation of the driving unit.

17. The method according to claim 13, wherein the driving unit is formed with a brushless motor.

18. A computer program product comprising a computer-readable medium having computer-readable program codes embodied in the computer-readable medium for controlling a sheet stacking device including a sheet stacking unit that stacks sheets thereon and that is movable up and down, a lifting unit that moves the sheet stacking unit up and down, a driving unit that drives the lifting unit, a control unit that controls a driving speed of the driving unit, and a position detecting unit that detects a position of the sheet stacking unit in an up-and-down direction, the program codes when executed causing the sheet stacking device to execute:

determining whether a moving-up time of the sheet stacking unit is equal to or greater than a threshold;

controlling the driving speed according to the position of the sheet stacking unit detected by the position detecting unit if the determining step determines that the moving-up time is equal to or greater than the threshold; and controlling the driving speed without the detected position if the determining step determines that the moving-up time is less than the threshold.

* * * * *